US010053318B2

(12) United States Patent
Chou et al.

(10) Patent No.: US 10,053,318 B2
(45) Date of Patent: Aug. 21, 2018

(54) PAPER SHEET HANDLING APPARATUS AND JOINT MODULE

(71) Applicant: MASTERWORK AUTOMODULES TECHNOLOGY CORP., LTD, Taipei (TW)

(72) Inventors: Hung-Hsun Chou, New Taipei (TW); Wen-Hsien Tsai, Taipei (TW)

(73) Assignee: MASTERWORK AUTOMODULES TECHNOLOGY CORP., LTD, Taipei (TW)

( * ) Notice: Subject to any disclaimer, the term of this patent is extended or adjusted under 35 U.S.C. 154(b) by 0 days.

(21) Appl. No.: 15/660,946

(22) Filed: Jul. 26, 2017

(65) Prior Publication Data

US 2018/0040188 A1 Feb. 8, 2018

(30) Foreign Application Priority Data

Aug. 5, 2016 (TW) ..... 105125070 A

(51) Int. Cl.

*B65H 5/36* (2006.01)
*G07D 11/00* (2006.01)
*G07F 19/00* (2006.01)

(52) U.S. Cl.

CPC ..... *B65H 5/36* (2013.01); *G07D 11/0021* (2013.01); *G07F 19/202* (2013.01); *G07F 19/203* (2013.01); *G07F 19/205* (2013.01); *B65H 2402/10* (2013.01); *B65H 2402/60* (2013.01); *B65H 2402/62* (2013.01); *B65H 2404/611* (2013.01); *B65H 2405/32* (2013.01); *B65H 2601/324* (2013.01); *B65H 2701/1912* (2013.01); *G07D 11/0081* (2013.01); *G07D 2211/00* (2013.01)

(58) Field of Classification Search

CPC ..... B65H 2402/10; B65H 2404/611; B65H 2404/691; B65H 2404/693; B65H 2404/7412; B65H 5/36; B65H 2402/62; B65H 2402/63; G07D 11/0081

See application file for complete search history.

(56) References Cited

U.S. PATENT DOCUMENTS 5,301,618 A * 4/1994 Abendschein ..... B65H 5/062 109/55
6,695,307 B2 2/2004 Kanagawa
(Continued)

FOREIGN PATENT DOCUMENTS

EP 1209633 A2 5/2002

*Primary Examiner* — Jeremy R Severson
(74) *Attorney, Agent, or Firm* — CKC & Partners Co., Ltd.

(57) ABSTRACT

A paper sheet handling apparatus includes a housing, a first unit, a second unit, and a joint module. At least one of the first and second units is a slidable paper sheet module slidably disposed at a rail on the housing and includes a module channel. The joint module is disposed in the housing and includes a main body, a moving shaft, a joint conveying channel, and a limiting member. The main body is located at a side of the rail. The moving shaft is slidably connected to the main body and configured to slide relative to the rail. The joint conveying channel is connected to the moving shaft. The limiting member is disposed on the main body and configured to limit the moving shaft to move between an outer point and an inner point. The outer point is located closer to the rail than the inner point.

16 Claims, 14 Drawing Sheets

(56) References Cited

U.S. PATENT DOCUMENTS

| | | | | |
|---|---|---|---|---|
| 8,511,681 | B2 * | 8/2013 | Nakata | G07D 11/0006 271/303 |
| 8,764,011 | B2 * | 7/2014 | Michels | G07D 11/0003 271/264 |
| 8,939,449 | B2 * | 1/2015 | Takada | B65H 5/26 271/264 |
| 2009/0212493 | A1 | 8/2009 | Burnard et al. | |
| 2012/0205221 | A1 | 8/2012 | Michels et al. | |
| 2013/0307210 | A1 | 11/2013 | Takada | |
| 2017/0116811 | A1 * | 4/2017 | Yokote | G07D 11/0081 |

* cited by examiner

PAPER SHEET HANDLING APPARATUS AND JOINT MODULE

RELATED APPLICATIONS

This application claims priority to Taiwan Application Serial Number 105125070, filed Aug. 5, 2016, which is herein incorporated by reference.

BACKGROUND

Field of Invention

The present invention relates to a paper sheet handling apparatus and a joint module

Description of Related Art

Nowadays, a conventional banknote handling apparatus, such as an automated teller machine (ATM) or national cash register (NCR), generally has an upper module and a lower module disposed therein. A user may input bank notes one by one into the upper module in the conventional banknote handling apparatus through an inlet/outlet of the conventional banknote handling apparatus. The upper module is primarily in charge of orderly feeding, conveying, and discrimination of the banknotes. The lower module is primarily used to store the banknotes conveyed by the upper module, and output the stored banknotes to the user via the upper module as well.

Generally speaking, the upper module and the lower module may be pulled out of the banknote handling apparatus from sliding rails, and thus a gap exists between the upper module and the lower module, thereby avoid causing interference when one of the modules is pulled out individually. However, the gap is likely to cause the banknote to be jammed therein when the banknotes pass through the upper module and the lower module, thus resulting in malfunction of the banknote handling apparatus.

Thus, there is a need to provide a banknote handling apparatus that can resolve the aforementioned problems in the industry.

SUMMARY

In view of the foregoing, an object of the present invention is to provide a paper sheet handling apparatus and a joint module to effectively reduce the occurrence of malfunction.

According to an embodiment, a paper sheet handling apparatus is provided. The paper sheet handling apparatus includes a housing, a first unit, a second unit, and a joint module. The first unit is disposed within the housing and is used to receive and dispense a paper sheet. The second unit is disposed within the housing and is used to store the paper sheet. At least one of the first unit and the second unit is a slidable paper sheet module which is slidably disposed at a rail of the housing and includes a module channel. The joint module is disposed between the first unit and the second unit, and includes a main body, a moving shaft, a joint conveying channel, and a limiting member. The main body is located at a side of the rail. The moving shaft is slidably connected to the main body and configured to slide towards or away from the rail. The joint conveying channel is connected to the moving shaft. The limiting member is disposed at the main body and configured to limit the moving shaft to move between an outer point and an inner point. The outer point is located closer to the rail than the inner point. When the moving shaft moves to the outer point, the joint conveying channel protrudes from a surface of the joint module facing towards the slidable paper sheet module, so as to dock with the module channel for conveying the paper sheet.

In some embodiments, the aforementioned channel module further includes a linkage. The linkage is pivotally connected to the main body and the moving shaft. When the slidable paper sheet module is sliding along the rail to an installation location in the housing, the slidable paper sheet module pushes the linkage to rotate, so as to move the moving shaft to the outer point and drive the joint conveying channel to slide towards the rail.

In some embodiments, the aforementioned limiting member is a slotted hole formed on the main body, and the moving shaft is slidably engaged with the slotted hole.

In some embodiments, the aforementioned joint module further includes a restoring member. The restoring member is operatively connected between the main body and the linkage, and the restoring member is configured to make the linkage rotate with respect to the main body so as to move the moving shaft towards the inner point.

In some embodiments, the aforementioned limiting member is configured to limit the moving shaft to move with respect to the main body along a first extending direction. The joint module further includes a first linkage, a motor, and a swing arm. The first linkage is slidably connected to the main body and is configured to move relative to the main body along a second direction. The moving shaft is slidably connected to the first linkage. The motor has a rotating shaft and is configured to rotate the rotating shaft along a first rotation direction or along a second rotation direction opposite to the first rotation direction. One end of the swing arm is connected to the rotating shaft, and another end of the swing arm is slidably connected to the first linkage. When the motor drives the rotating shaft to rotate along the first rotation direction, the moving shaft is indirectly driven to move to the outer point, and when the motor drives the rotating shaft to rotate along the second rotation direction, the moving shaft is indirectly driven to move to the inner point.

In some embodiments, the aforementioned channel module further includes a first optical sensor, a second optical sensor, and a controller. The first optical sensor is disposed at the main body. The second optical sensor is disposed at the main body. When the moving shaft is located at the inner point, the first linkage does not trigger the first optical sensor and the second optical sensor. When the moving shaft is located at the outer point, the first linkage triggers the first optical sensor but does not trigger the second optical sensor. When the moving shaft moves between the inner point and the outer point, the first linkage triggers the second optical sensor but does not trigger the first optical sensor. The controller is configured to generate a first stop signal when the first linkage does not trigger the first optical sensor and the second optical sensor, and the controller is further configured to generate a second stop signal when the first linkage triggers the first optical sensor but does not trigger the second optical sensor. The activated motor is stopped according to the first stop signal and the second stop signal.

In some embodiments, the aforementioned first linkage has a first sliding slot, a second sliding slot, and a third sliding slot. The first sliding slot is substantially parallel to the first extending direction. The aforementioned another end of the swing arm is slidably engaged with the first sliding slot. The second sliding slot is substantially parallel to the second extending direction. The main body is slidably engaged with the second sliding slot. The third sliding slot is not parallel to the first extending direction and the second extending direction, and the moving shaft is slidably engaged with the third sliding slot.

In some embodiments of the present invention, the aforementioned joint module further includes two second linkages and a connecting shaft. The two second linkages are pivotally connected to two ends of the moving shaft respectively. The connecting shaft are rotatably connected to the main body and connected between the second linkages.

According to another embodiment of the present invention, a joint module is provided. The joint module is disposed within a housing and is located between a first unit used to receive and dispense a paper sheet and a second unit used to store the paper sheet. At least one of the first unit and the second unit is a slidable paper sheet module that is slidably disposed within the housing. The joint module includes a main body, a joint conveying channel, a moving shaft, and a limiting member. The moving shaft is slidably connected to the main body. The joint conveying channel is connected to the moving shaft. The limiting member is disposed at the main body and is configured to limit the moving shaft to move between an outer point and an inner point. The outer point is located closer to the slidable paper sheet module than the inner point. When the moving shaft moves to the outer point, the joint conveying channel protrudes from a surface of the joint module facing towards the slidable paper sheet module, so as to dock with a channel module of the slidable paper sheet module for conveying the paper sheet.

In sum, an additional joint module is added to the paper sheet handling apparatus of the present invention between the upper slidable paper sheet module and the lower slidable paper sheet module, so as to overcome the issue that the paper sheet might be jammed therebetween when passing between the upper slidable paper sheet module and the lower slidable paper sheet module. Also, the joint module includes joint conveying channels that can extend to the upper slidable paper sheet module and the lower slidable paper sheet module. Before the upper slidable paper sheet module and the lower slidable paper sheet module slide to the predetermined installing location within the paper sheet handling apparatus, the joint conveying channel of the joint module will not protrude to engage with the structure of the upper slidable paper sheet module and the lower slidable paper sheet module. When the upper slidable paper sheet module and the lower slidable paper sheet module slide to the predetermined location within the paper sheet handling apparatus, the joint conveying channel of the joint module will be driven to protrude towards the upper slidable paper sheet module and the lower slidable paper sheet module respectively, so as to dock with the first module channel of the upper slidable paper sheet module and the second module channel of the lower slidable paper sheet module respectively.

These and other features, aspects, and advantages of the present invention will become better understood with reference to the following description and appended claims.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
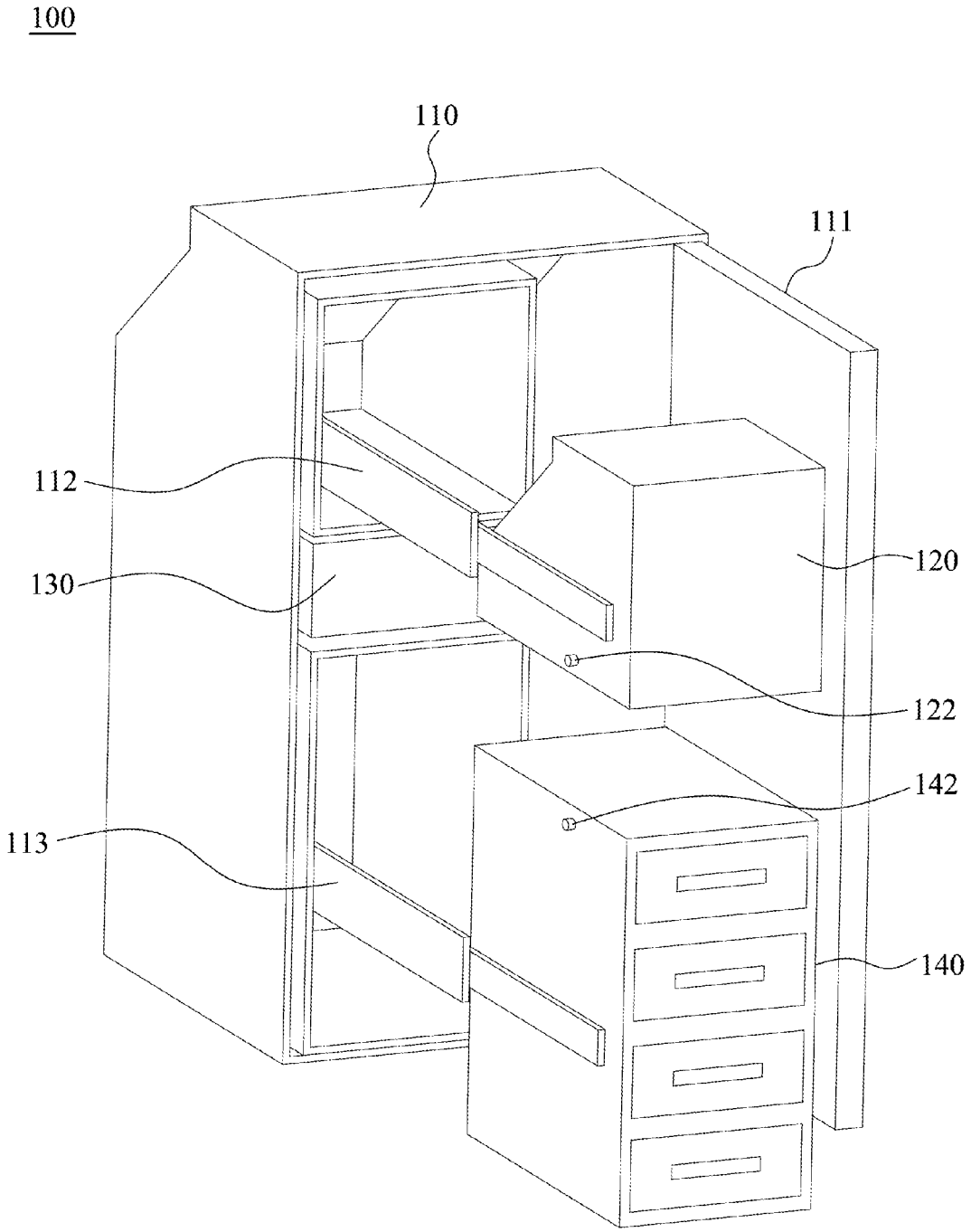
FIG. 1 is a schematic 3-D view of a paper sheet handling apparatus according to an embodiment.

Reference will now be made in detail to the present embodiments of the invention, examples of which are illustrated in the accompanying drawings. Wherever possible, the same reference numbers are used in the drawings and the description to refer to the same or like parts.

Please refer to FIG. 1. FIG. 1 is a schematic 3-D view of a paper sheet handling apparatus according to an embodiment of the present invention. As shown in FIG. 1, in the present embodiment, a paper sheet handling apparatus 100 includes a housing 110, a first unit, a second unit, and a joint module 130. The housing 110 has an openable back door 111 to expose the internal space of the housing 110. The paper sheet is, for example, a banknote, a check or other suitable paper sheets, and the invention is not limited thereto. The first unit is an upper slidable paper sheet module 120, and the second unit is a lower slidable paper sheet module 140. The upper slidable paper sheet module 120 is used to receive and dispense paper sheets. The lower slidable paper sheet module 140 is used to store paper sheets. By opening the back door 111, the upper slidable paper sheet module 120 and the lower slidable paper sheet module 140 can be installed into or removed from the housing 110. A first rail 112 and a second rail 113 are disposed within the housing 110. The upper slidable paper sheet module 120 is slidably disposed at the first rail 112, and the lower slidable paper sheet module 140 is slidably disposed at the second rail 113. The joint module 130 is disposed within the housing 110, and is located between predetermined installation space for the upper slidable paper sheet module 120 and that for the lower slidable paper sheet module 140. In other words, when the upper slidable paper sheet module 120 and the lower slidable paper sheet module 140 have been installed within the housing 110, the joint module 130 is located between the upper slidable paper sheet module 120 and the lower slidable paper sheet module 140. In some embodiments, the joint module 130 is disposed between the upper slidable paper sheet module 120 and the lower slidable paper sheet module 140 to overcome the issue that the paper sheets might be jammed therebetween when passing between the upper slidable paper sheet module 120 and the lower slidable paper sheet module 140. The device structures, functionalities, and the connections and the relationships among the elements of the paper sheet handling apparatus 100 will be described in detail hereinafter.

Figure 2:
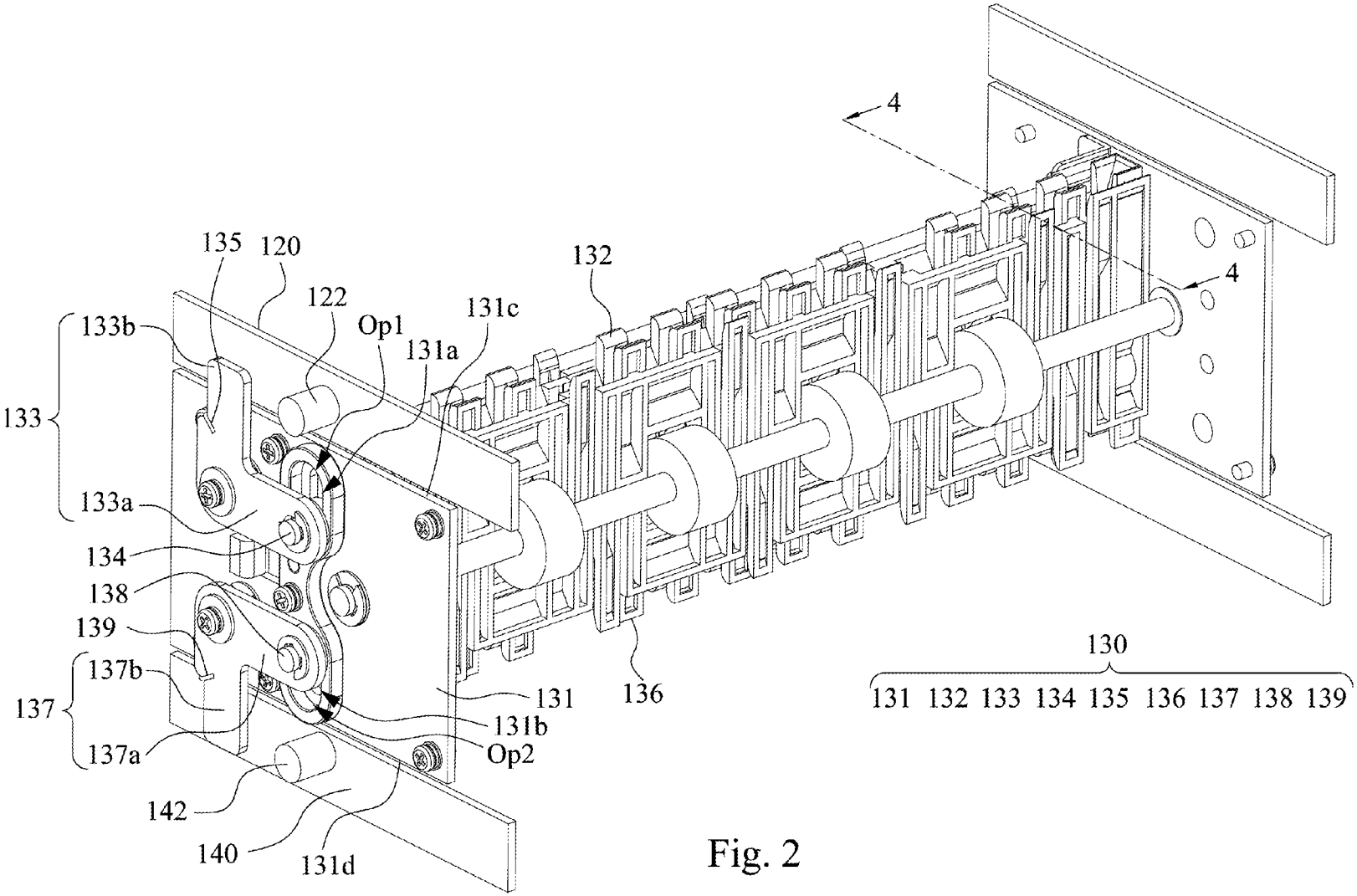
FIG. 2 is a partial 3-D view of an upper slidable paper sheet module, a joint module, and a lower slidable paper sheet module according to an embodiment.
Figure 3:
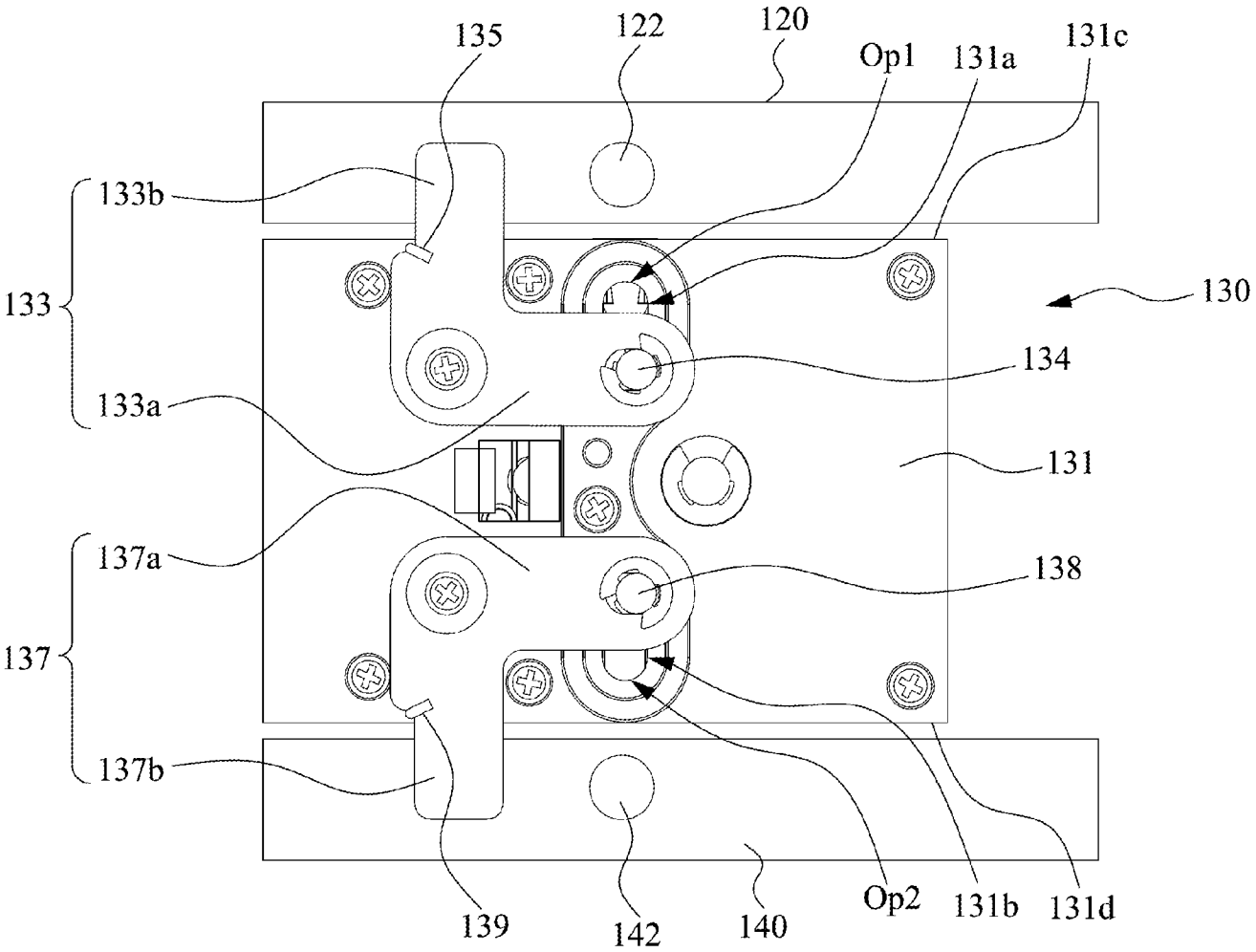
FIG. 3 is a left side view of the structure shown in FIG. 2.
Figure 4:
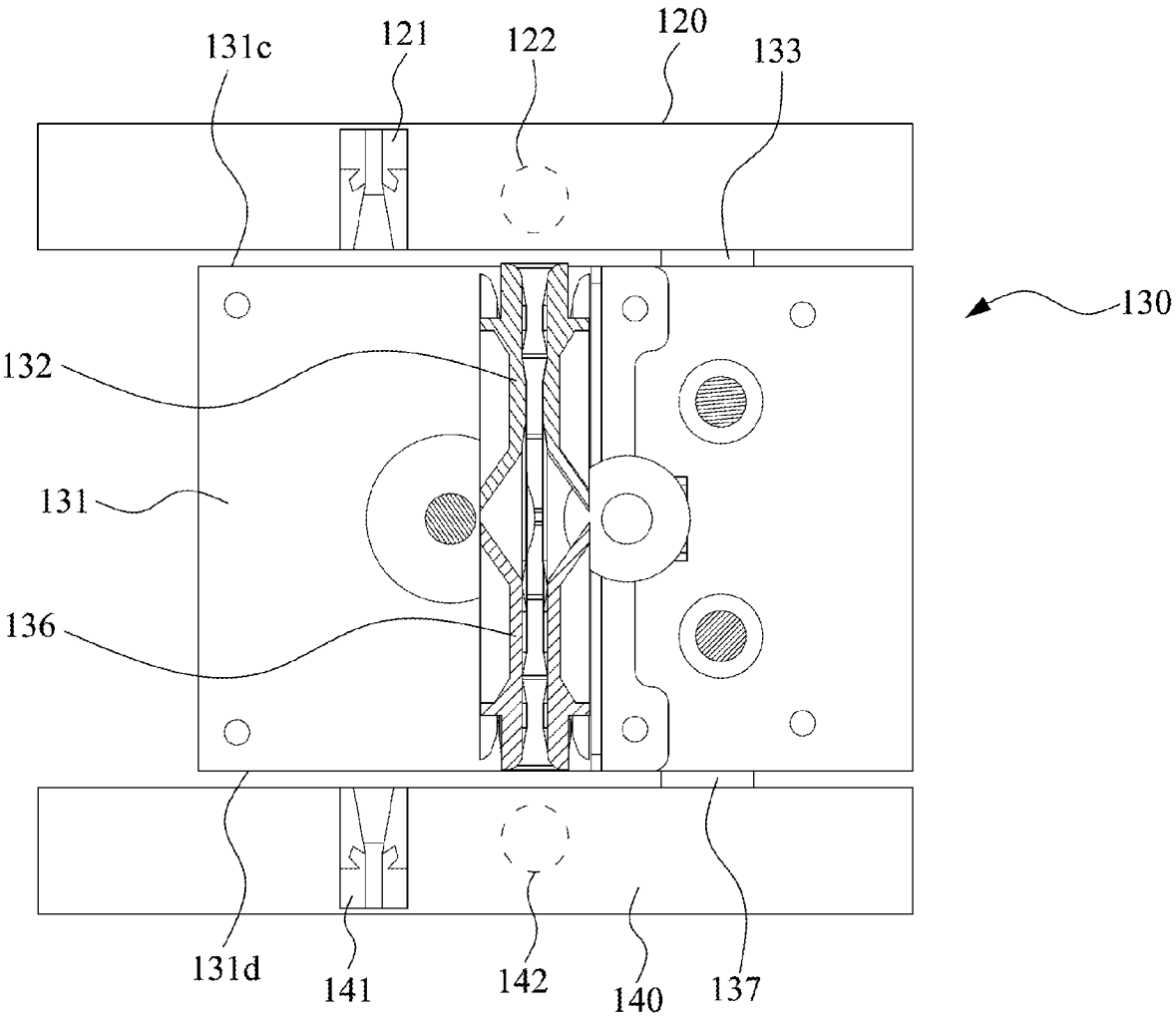
FIG. 4 is a cross-sectional view of the structure shown in FIG. 2 viewed along a line 4-4.
Figure 5:
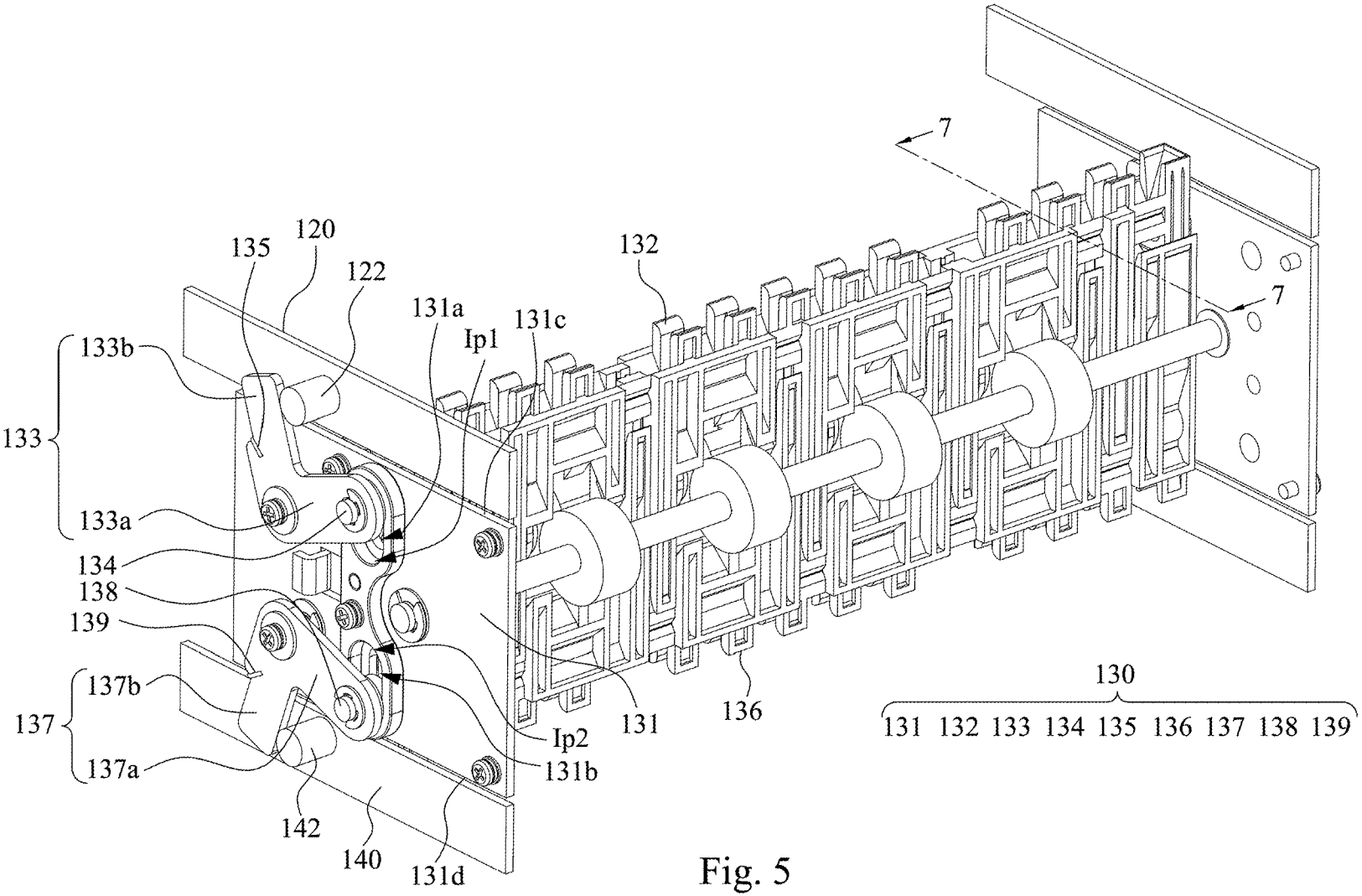
FIG. 5 is another partial 3-D view of the upper slidable paper sheet module, the joint module, and the lower slidable paper sheet module shown in FIG. 2.
Figure 6:
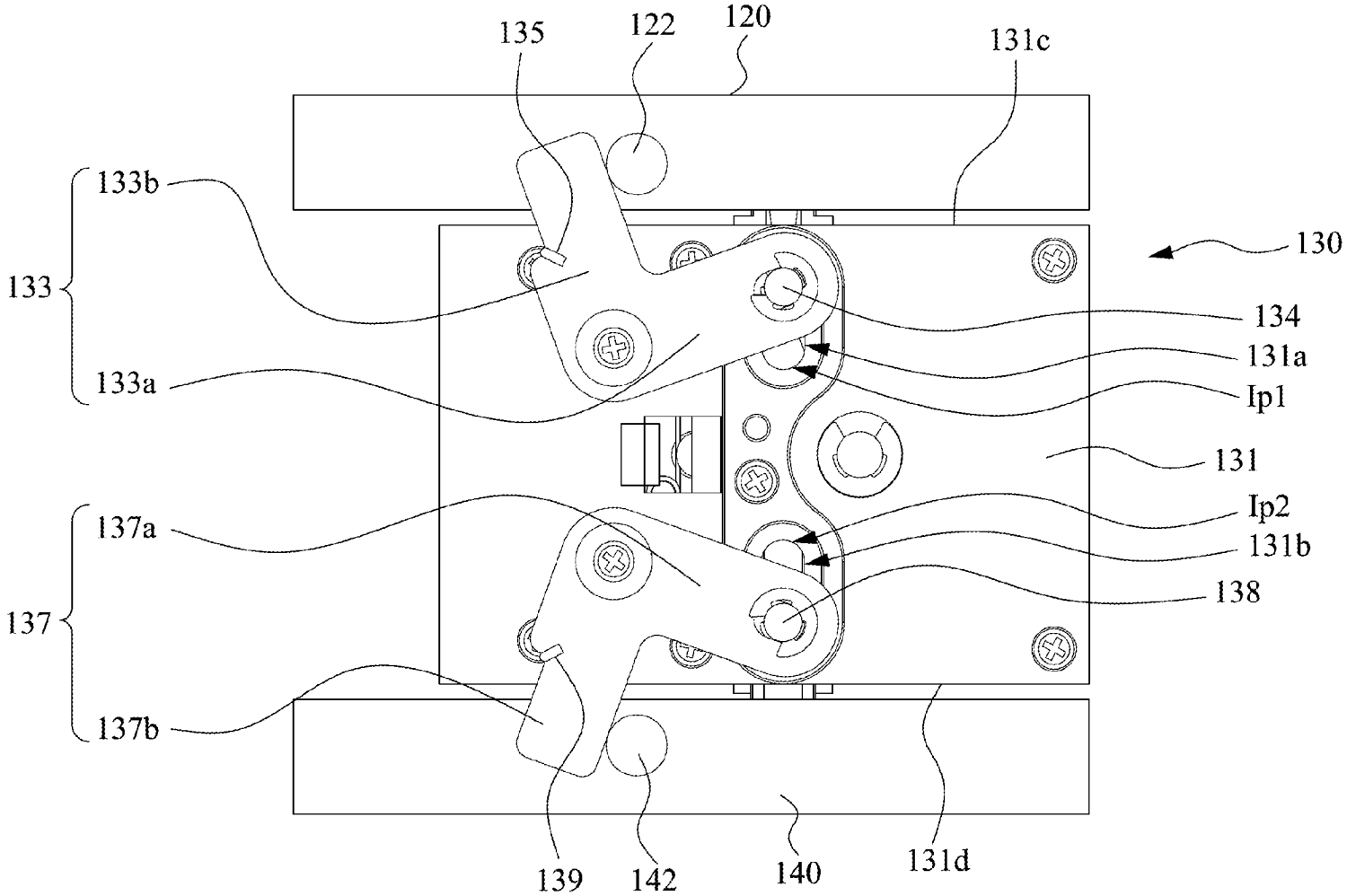
FIG. 6 is a left side view of the structure shown in FIG. 5.
Figure 7:
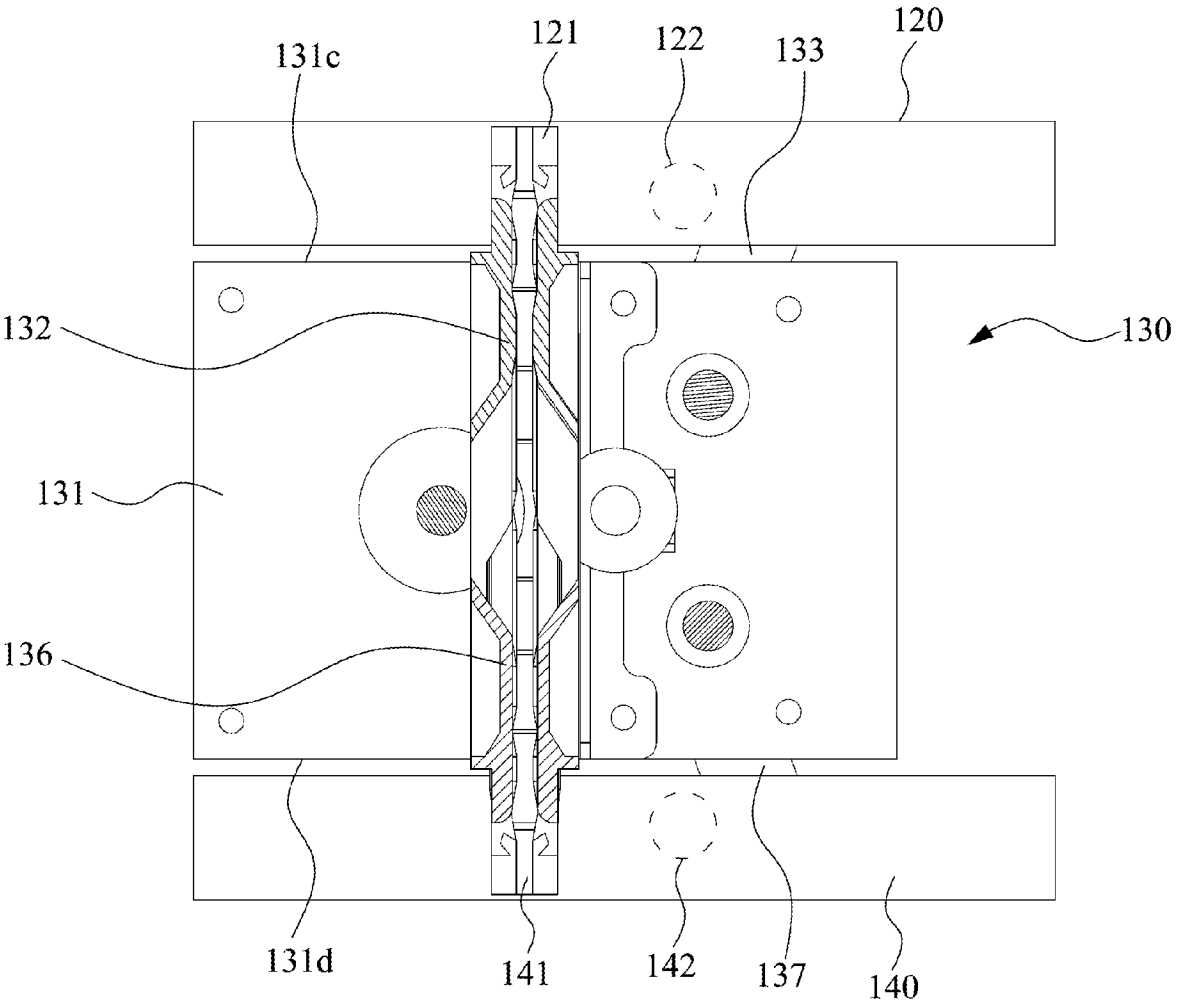
FIG. 7 is a cross-sectional view of the structure shown in FIG. 5 viewed along a line 7-7.

Please refer to FIG. 2 to FIG. 7. FIG. 2 is a partial 3-D view of the upper slidable paper sheet module 120, the joint module 130, and the lower slidable paper sheet module 140 according to an embodiment. FIG. 3 is a left side view of the structure shown in FIG. 2. FIG. 4 is a cross-sectional view of the structure shown in FIG. 2 viewed along a line 4-4. FIG. 5 is another partial 3-D view of the upper slidable paper sheet module 120, the joint module 130, and the lower slidable paper sheet module 140 shown in FIG. 2. FIG. 6 is a left side view of the structure shown in FIG. 5. FIG. 7 is a cross-sectional view of the structure shown in FIG. 5 viewed along a line 7-7. As shown in FIG. 2 to FIG. 7, in the present embodiment, the upper slidable paper sheet module 120 includes a first channel module 121 and the lower slidable paper sheet module 140 includes a second channel module 141. The joint module 130 includes a main body 131, a first joint conveying channel 132, a first linkage 133, a second joint conveying channel 136, and a second linkage 137. The main body 131 located between the first rail 112 and the second rail 113 (see FIG. 1). The first joint conveying channel 132 is slidably connected to the main body 131 and is configured to slide towards or away from the first rail 112. The first linkage 133 is pivotally connected to the main body 131 and operatively connected to the first joint conveying channel 132. The second joint conveying channel 136 is slidably connected to the main body 131 and is configured to move towards or away from the second rail 113. The second linkage 137 is pivotally connected to the main body 131 and is operatively connected to the second joint conveying channel 136. As the first joint conveying channel 132 and the second joint conveying channel 136 slide relatively to the main body 131, the first joint conveying channel 132 and the second joint conveying channel 136 dock with each other to convey the paper sheets.

It should be realized that the docking might be a contact docking or a non-contact docking as long as the paper sheets may be smoothly conveyed between the first joint conveying channel 132 and the second joint conveying channel 136.

In detail, as shown in FIG. 2 to FIG. 4, before the upper slidable paper sheet module 120 is in contact with the first linkage 133 of the joint module 130, the first joint conveying channel 132 of the joint module 130 does not protrude to interfere with the structure of the upper slidable paper sheet module 120. Similarly, before the lower slidable paper sheet module 140 is in contact with the second linkage 137 of the joint module 130, the second joint conveying channel 136 of the joint module 130 does not protrude to interfere with the structure of the lower slidable paper sheet module 140.

As shown in FIG. 5 to FIG. 7, when the upper slidable paper sheet module 120 is sliding along the first rail 112 to the first installing location in housing 110 (where the upper slidable paper sheet module 120 is located in FIG. 5 to FIG. 7), the upper slidable paper sheet module 120 pushes the first linkage 133 to rotate, so as to drive the first joint conveying channel 132 to slide towards the first rail 112 (as shown in FIG. 6). As the upper slidable paper sheet module 120 is located at the first installing location, the first joint conveying channel 132 protrudes from a upper surface 131*c* of the joint module 130 that faces towards the upper slidable paper sheet module 120, so as to dock with the first channel module 121 (as shown in FIG. 7) for conveying the paper sheets. Similarly, when the lower slidable paper sheet module 140 is sliding along the second rail 113 to a second installing location of the housing 110 (where the lower slidable paper sheet module 140 is located in FIG. 5 to FIG. 7), the lower slidable paper sheet module 140 pushes the second linkage 137 to rotate so as to drive the second joint conveying channel 136 to slide towards the second rail 113 (as shown in FIG. 6). When the lower slidable paper sheet module 140 is located at the second installing location, the second joint conveying channel 136 protrudes from a lower surface 131*d* of the joint module 130 that faces towards the lower slidable paper sheet module 140 to dock with the second channel module 141 (as shown in FIG. 7) for conveying paper sheets.

As shown in the aforementioned configuration, before the upper slidable paper sheet module 120 and the lower slidable paper sheet module 140 are in contact with the first linkage 133 and the second linkage 137 respectively, the first joint conveying channel 132 and the second joint conveying channel 136 of the joint module 130 do not protrude to interfere with the structure of the upper slidable paper sheet module 120 and lower slidable paper sheet module 140 respectively, and thus the upper slidable paper sheet module 120 and the lower slidable paper sheet module 140 may be smoothly installed into or removed from the housing 110 by an assembling or maintenance personnel. Not until the upper slidable paper sheet module 120 and the lower slidable paper sheet module 140 contact the first linkage 133 and the second linkage 137 respectively and further slide to the first installing location and the second installing location respectively, the first joint conveying channel 132 and the second joint conveying channel 136 does not protrude towards the upper slidable paper sheet module 120 and the lower slidable paper sheet module 140 (the first joint conveying channel 132 and the second joint conveying channel 136 protrude from the upper surface 131*c* and the lower surface 131*d* respectively), so as to dock with the first channel module 121 and the second channel module 141.

It should be realized that the docking might be a contact docking or a non-contact docking as long as the paper sheets may be smoothly conveyed between the first joint conveying channel 132 and the first channel module 121, and between the second joint conveying channel 136 and the second channel module 141.

As shown in FIGS. 2, 3, 5, and 6, in the present embodiment, the joint module 130 further includes a first moving shaft 134, a first limiting member, a second moving shaft 138, and a second limiting member. The first moving shaft 134 is connected to the first joint conveying channel 132. The first limiting member is disposed at the main body 131 and is configured to limit the first moving shaft 134 to move between the first outer point Op1 (see FIG. 2 and FIG. 3) and the first inner point Ip1 (see FIG. 5 and FIG. 6). The first outer point Op1 is located closer to the first rail 112 (with reference to FIG. 1) than the first inner point Ip1. When the first joint conveying channel 132 protrudes from the upper surface 131*c* of the joint module 130 to dock with the first channel module 121, the first moving shaft 134 is located at the first outer point Op1. The second moving shaft 138 is connected to the second joint conveying channel 136. The second limiting member is disposed at the main body 131 and is configured to limit the second moving shaft 138 to move between a second outer point Op2 (see FIG. 2 and FIG. 3) and a second inner point Ip2 (see FIG. 5 and FIG. 6). The second outer point Op2 is located closer to the second rail 113 than the second inner point Ip2 (with reference to FIG. 1). When the second joint conveying channel 136 protrudes from the lower surface 131*d* of the joint module 130 to dock with the second channel module 141, the second moving shaft 138 is located at the second outer point Op2.

In practice, as shown in FIGS. 2, 3, 5, 6, in the present embodiment, a side wall of the upper slidable paper sheet module 120 includes a first pushing block 122 and a side wall of the lower slidable paper sheet module 140 includes a second pushing block 142. The first linkage 133 includes a first actuator 133*a* and a first abutting part 133*b*. The first actuator 133*a* and the first abutting part 133*b* are connected with each other as an L shape. The first linkage 133 is pivotally connected to the main body 131 in a position at which the first actuator 133*a* and the first abutting part 133*b* are connected with each other. An end of the first actuator 133*a* distal from the first abutting part 133*b* is connected to the first moving shaft 134. When the upper slidable paper sheet module 120 is sliding along the first rail 112 to the first installing location, the first pushing block 122 can push the first abutting part 133*b* to make the first linkage 133 rotate with respect to the main body 131, so as to drive the first moving shaft 134 to slide from the first inner point Ip1 to the first outer point Op1. Relatively, the second linkage 137 includes a second actuator 137*a* and a second abutting part 137*b*. The second actuator 137*a* and the second abutting part 137*b* are connected with each other in an L shape. The second linkage 137 is pivotally connected to the main body 131 at a position at which the second actuator 137*a* and the second abutting part 137*b* are connected with each other. An end of the second actuator 137*a* away from the second abutting part 137*b* is connected to the second moving shaft 138. When the lower slidable paper sheet module 140 is sliding along the second rail 113 to the second installing location, the second pushing block 142 can push the second abutting part 137*b* to make the second linkage 137 rotate with respect to the main body 131, so as to drive the second moving shaft 138 to slide from the second inner point Ip2 to the second outer point Op2.

In the present embodiment, the first limiting member is a slotted hole 131*a* formed on the main body 131. The first moving shaft 134 is slidably engaged with the slotted hole 131*a*. Similarly, the second limiting member is a second slotted hole 131*b* formed on the main body 131. The second moving shaft 138 is slidably engaged with the second slotted hole 131*b*.

Since the first moving shaft 134 is driven by the first linkage 133 to rotate in a circular motion around the axis of first linkage 133, to allow the first moving shaft 134 to be sliadable in the slotted hole 131*a*, the width of the slotted hole 131*a* needs to be slightly larger than the diameter of the first moving shaft 134. Similarly, since the second moving shaft 138 is driven by the second linkage 137 to rotate in a circular motion around the axis of the second linkage 137, to allow the second moving shaft 138 to be slidable in the second slotted hole 131*b*, the width of the second slotted hole 131*b* needs to be slightly larger than the diameter of the second moving shaft 138.

In some embodiments, the first actuator 133*a* of the first linkage 133 may also be disposed with a slotted hole (not shown) together with the slotted hole 131*a* to limit the first moving shaft 134. In this case, the width of the slotted hole 131*a* may be equal to the diameter of the first moving shaft 134. Similarly, in some embodiments, the second actuator 137*a* of the second linkage 137 may also be disposed with a slotted hole (not shown) together with the second slotted hole 131*b* to limit the second moving shaft 138. In this case, the width of the second slotted hole 131*b* may be equal to the diameter of the second moving shaft 138.

In the present embodiment, the extending direction of the slotted hole 131*a* is substantially perpendicular to the sliding direction of the upper slidable paper sheet module 120 relative to the joint module 130 (the extending direction of the first rail 112), and the extending direction of the second slotted hole 131*b* is substantially perpendicular to the sliding direction of the lower slidable paper sheet module 140 relative to the joint module 130 (the extending direction of second rail 113), but the present invention is not limited thereto, adjustments may be made for practical requirements. For example, to prevent the protrusion of first joint conveying channel 132 and the second joint conveying channel 136 from structural interference, the extending direction of the slotted hole 131*a* can be made to incline with respect to the sliding direction of the upper slidable paper sheet module 120 relative to the joint module 130, and the extending direction of the second slotted hole 131*b* can be made to incline with respect to the sliding direction of the lower slidable paper sheet module 140 relative to the joint module 130.

In the present embodiment, the slotted hole 131*a* and the second slotted hole 131*b* are both straight slots, but the present invention is not limited thereto. In practical applications, the slotted hole 131*a* and the second slotted hole 131*b* may also be curved slots.

As shown in FIG. 2 and FIG. 5, in the present embodiment, to enable the first moving shaft 134 to drive the first joint conveying channel 132 smoothly, two opposite side walls of the main body 131 may be disposed with symmetric devices. For example, the two opposite side walls can be disposed with two slotted holes 131*a* to be slidably engaged with two ends of the first moving shaft 134 respectively, and disposed with two first linkages 133 to drive the two ends of the first moving shaft 134 respectively. Similarly, to enable the second moving shaft 138 to drive the second joint conveying channel 136 smoothly, the two sides of the main body 131 can be disposed with two second slotted holes 131*b* to be slidably engaged with the two ends of the second moving shaft, and disposed with two second linkages 137 to drive the two ends of the second moving shaft 138 respectively.

As shown in FIGS. 2, 3, 5, and 6, in the present embodiment, the joint module 130 further includes a first restoring member 135 and a second restoring member 139. The first restoring member 135 is operatively connected between the main body 131 and the first linkage 133, and is configured to make the first linkage 133 to rotate with respect to the main body 131, so as to move the first moving shaft 134 towards the first inner point Ip1. The second restoring member 139 is operatively connected between the main body 131 and the second linkage 137, and is configured to make the second linkage 137 to rotate with respect to the second moving shaft 138, so as to move the second moving shaft 138 towards the second inner point Ip2.

For example, as shown in FIG. 3, in the present embodiment, the first restoring member 135 and the second restoring member 139 are both torsion springs. One end of the first restoring member 135 is connected to the main body 131, and another end abuts against a side of the first linkage 133, such that the first linkage 133 may rotate clockwise with respect to the main body 131, further moving the first moving shaft 134 to the first inner point Ip1. Relatively, one end of the second restoring member 139 is connected to the main body 131, and another end of the second restoring member 139 abuts against a side of the second linkage 137, such that the second linkage 137 may rotate counterclockwise with respect to the main body 131, further moving the second moving shaft 138 towards the second inner point Ip2. However, the first restoring member 135 and the second restoring member 139 are not limited thereto, and other elastic elements may also be used.

In practical applications, the joint module 130 may also be disposed with only one slotted hole 131*a* on the main body 131 according to the upper slidable paper sheet module 120, and merely includes a first joint conveying channel 132, a first linkage 133, a first moving shaft 134, and a first restoring member 135. Alternatively, joint module 130 may also be disposed with only one second slotted hole 131*b* on the main body 131 according to the lower slidable paper sheet module 140, and merely includes a second joint conveying channel 136, a second linkage 137, a second moving shaft 138, and a second restoring member 139.

Figure 8:
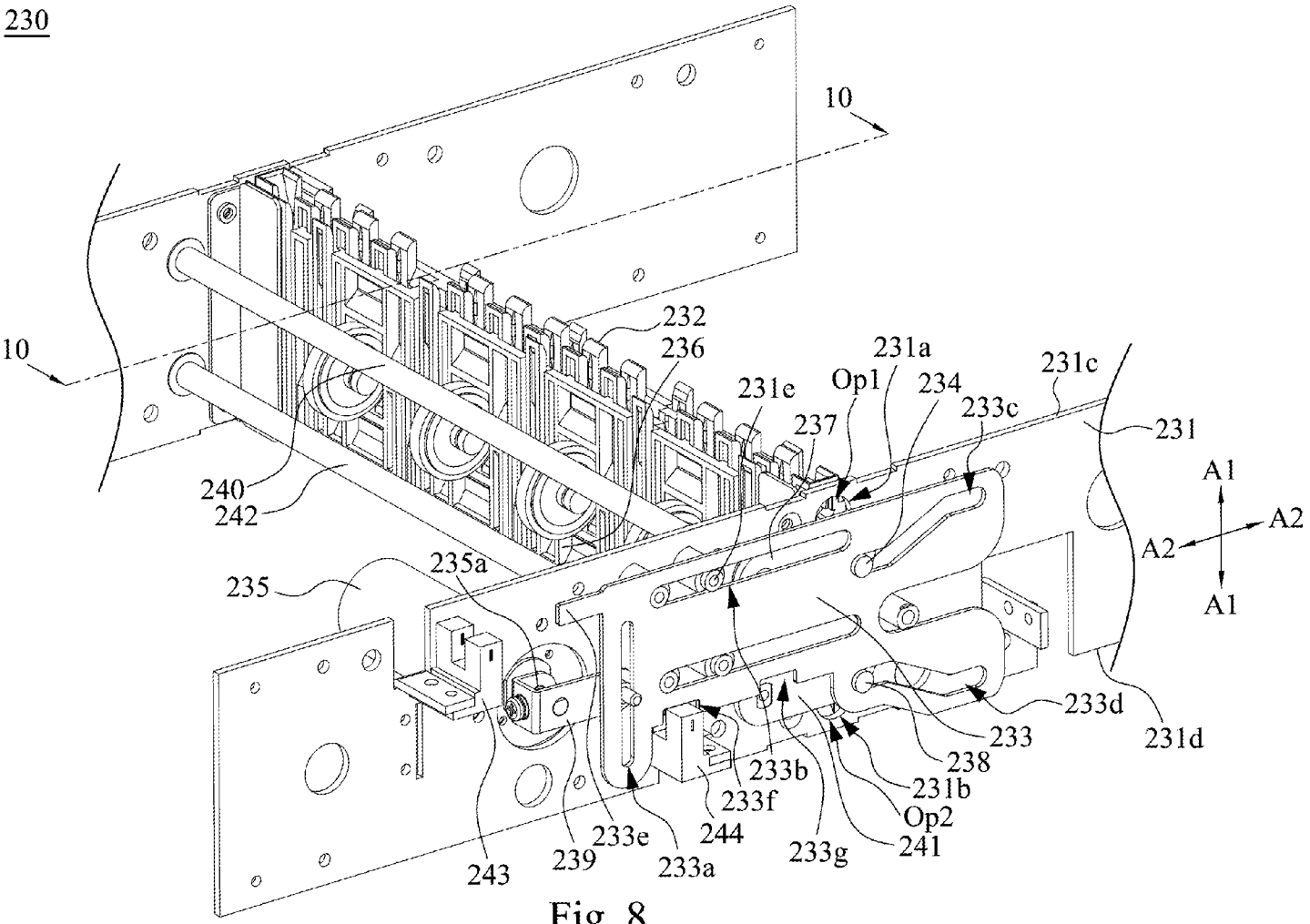
FIG. 8 is a partial 3-D view of a joint module according to another embodiment.
Figure 9:
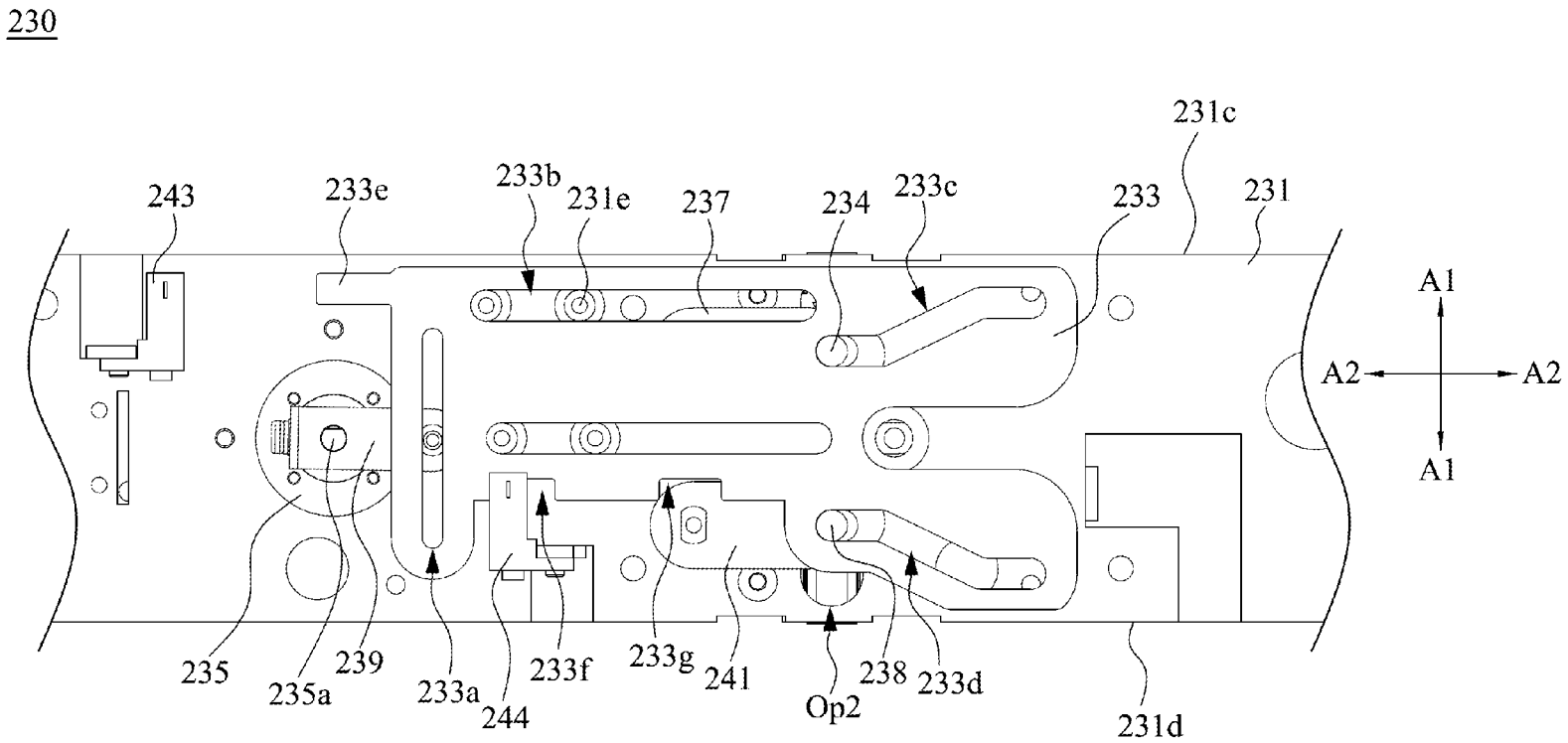
FIG. 9 is a right side view of the structure shown in FIG. 8.
Figure 10:
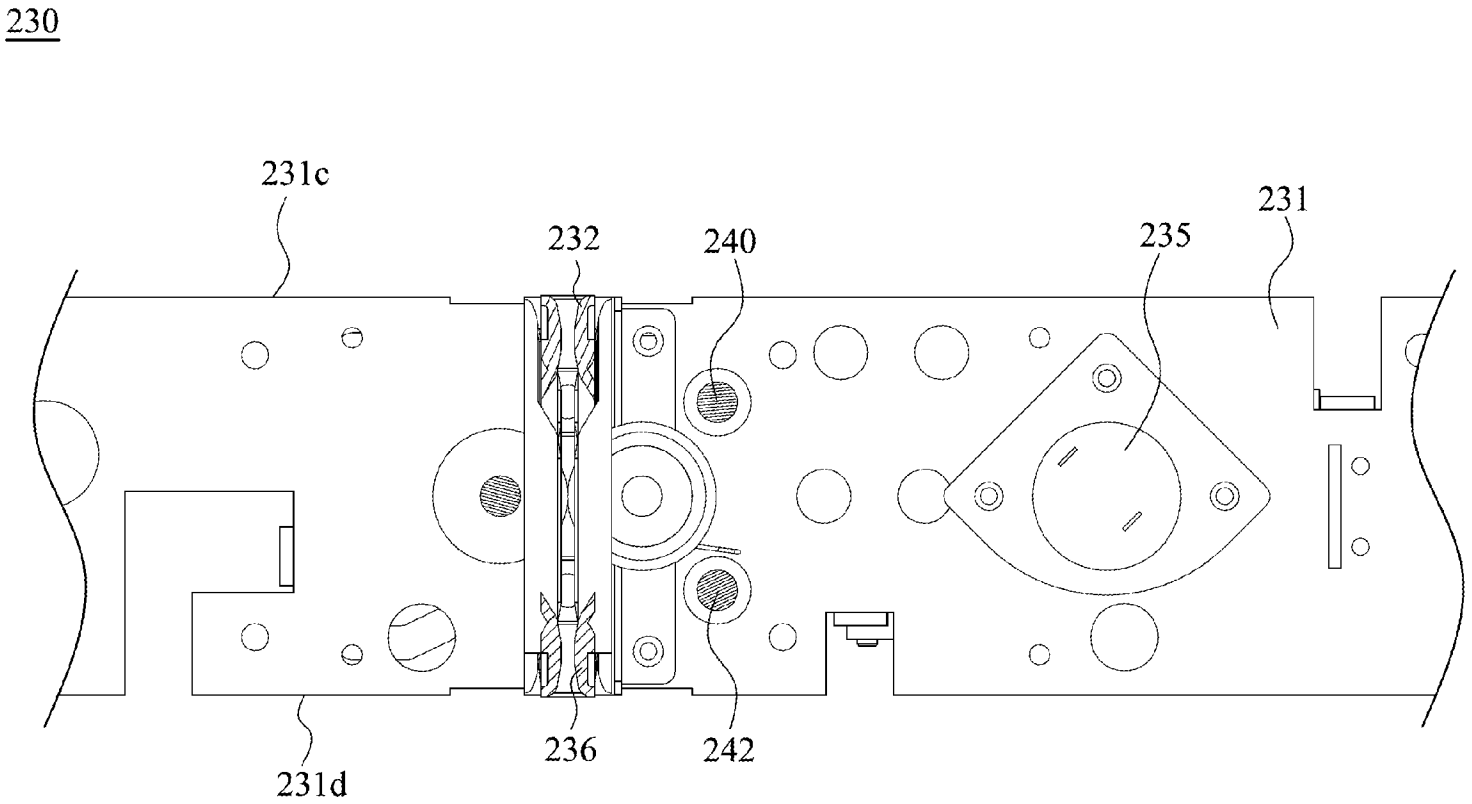
FIG. 10 is a cross-sectional view of the structure shown in FIG. 8 viewed along a line 10-10.
Figure 11:
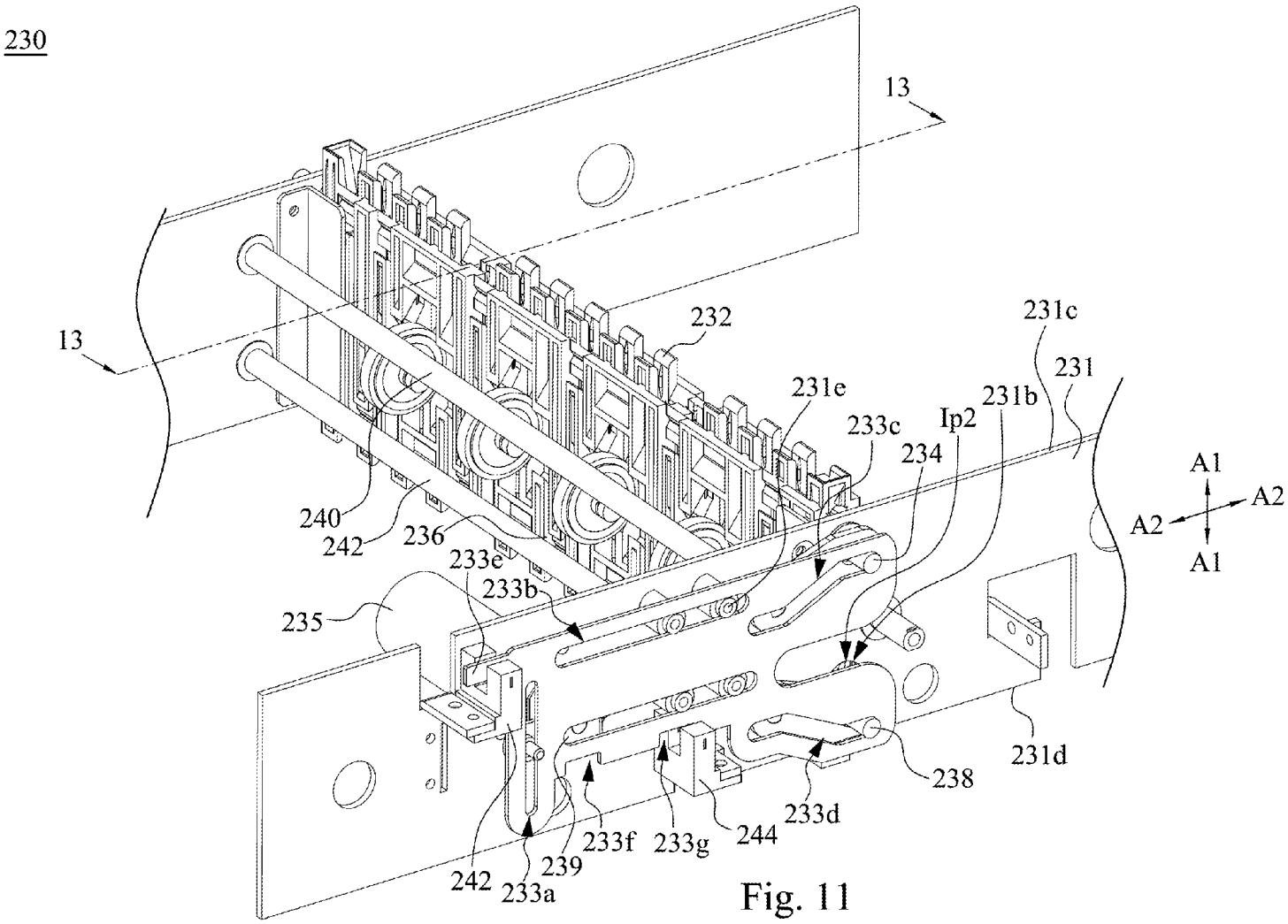
FIG. 11 is another partial 3-D view of the joint module shown in FIG. 8.
Figure 12:
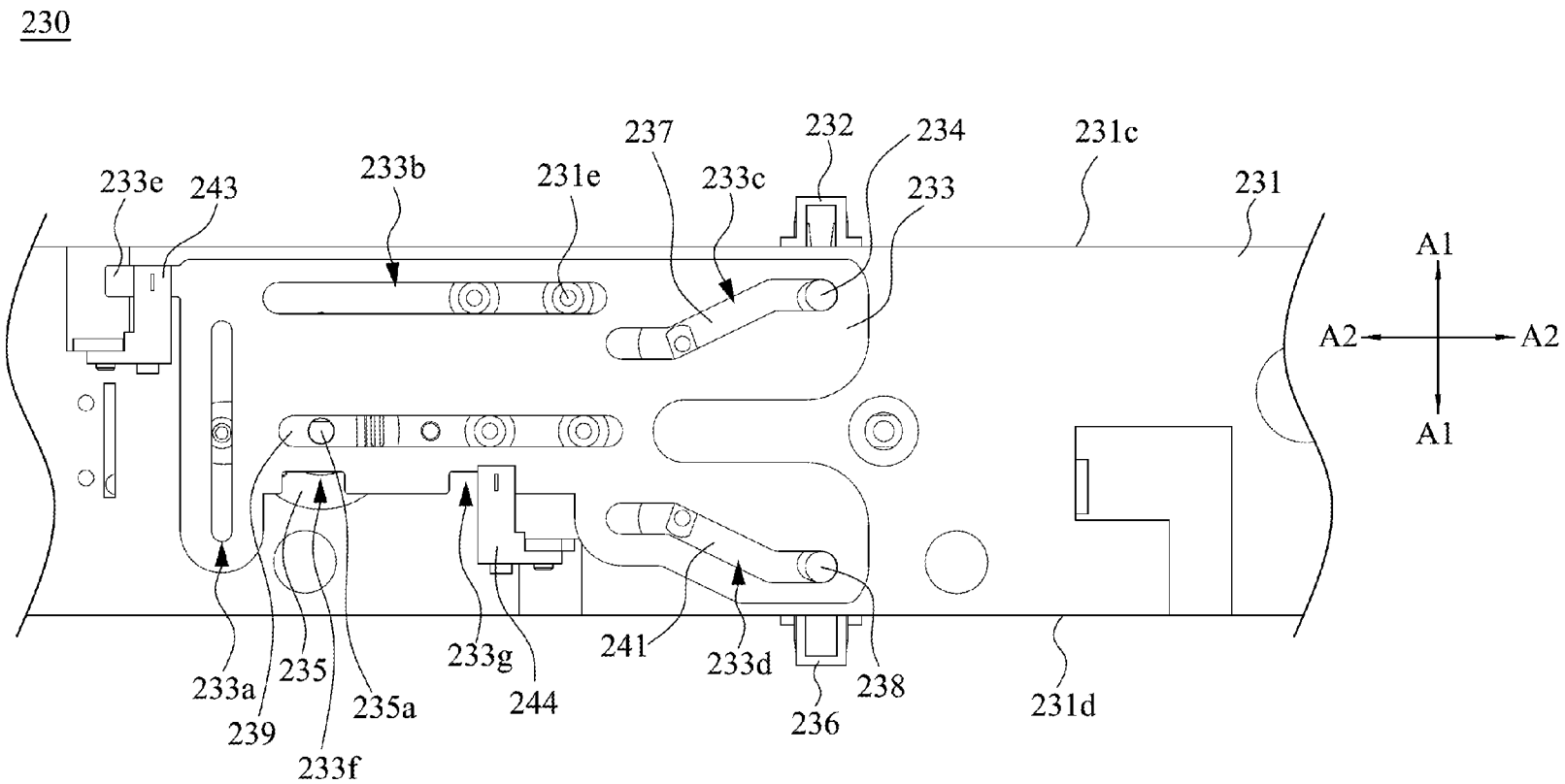
FIG. 12 is a right side view of the structure shown in FIG. 11.
Figure 13:
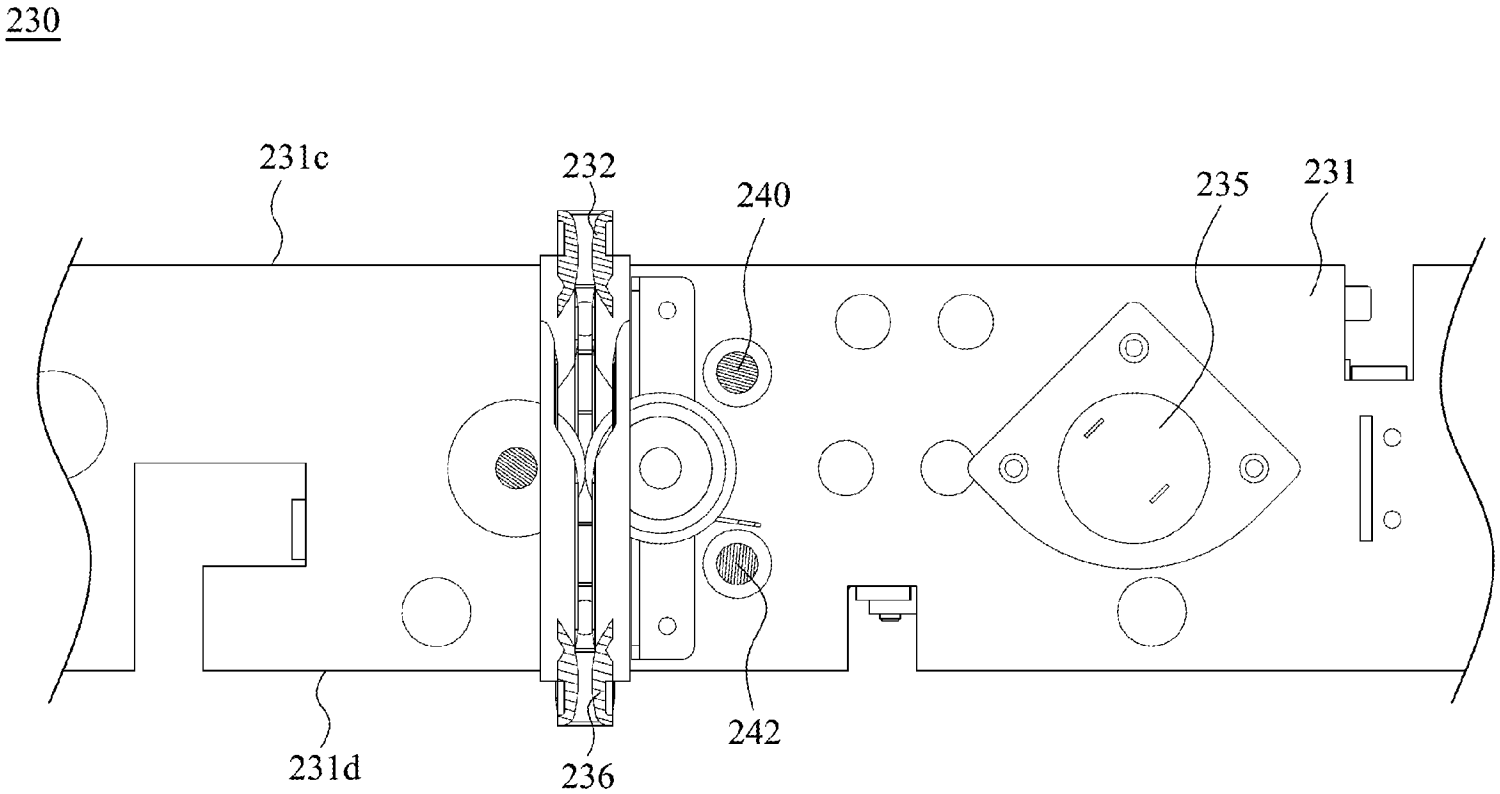
FIG. 13 is a cross-sectional view of the structure shown in FIG. 11 viewed along a line 13-13.

Please refer to FIG. 8 to FIG. 13. FIG. 8 is a partial 3-D view of a joint module according to another embodiment. FIG. 9 is a right side view of the structure shown in FIG. 8. FIG. 10 is a cross-sectional view of the structure shown in FIG. 8 viewed along a line 10-10. FIG. 11 is another partial 3-D view of the joint module 230 shown in FIG. 8. FIG. 12 is a right side view of the structure in FIG. 11. FIG. 13 is a cross-sectional view of the structure shown in FIG. 11 viewed along a line 13-13. It should be realized that the joint module 230 of the present embodiment can be used to replace the joint module 130 in FIG. 2. Also, the joint module 230 of the present embodiment does not need the upper slidable paper sheet module 120 and the lower slidable paper sheet module 140 for substantial actuation, and is different from the joint module 130 in FIG. 2 that needs the substantial actuation of the upper slidable paper sheet module 120 and the lower slidable paper sheet module 140. As such, the first pushing block 122 and the second pushing block 142 can be omitted from the upper slidable paper sheet module 120 and the lower slidable paper sheet module 140 respectively. The principles of practical actuation for the joint module 230 will be described in details hereinafter.

As shown in FIG. 8 to FIG. 13, in the present embodiment, the joint module 230 includes a main body 231, a first joint conveying channel 232, a first moving shaft 234, a first limiting member, a first linkage 233, a motor 235, a swing arm 239, a second joint conveying channel 236, a second moving shaft 238, and a second limiting member. The main body 231 is located at a side of the first rail 112 (referring to FIG. 1). The first moving shaft 234 is slidably connected to the main body 231, and is configured to move towards or away from the first rail 112. The first joint conveying channel 232 is connected to the first moving shaft 234. The first limiting member is disposed at the main body 231, and is configured to limit the first moving shaft 234 to move between the first outer point Opt and the first inner point Ip1 along a first extending direction A1 relative to the main body 231 (the first inner point Ip1 is blocked and cannot be seen in FIG. 8, but can be seen in FIG. 5 and FIG. 6). The first outer point Opt is located closer to the first rail 112 than the first inner point Ip1. The first linkage 233 is slidably connected to the main body 231, and is configured to slide along the second extending direction A2 relative to the main body 231. The first moving shaft 234 is slidably connected to the first linkage 233. Otherwise, the second moving shaft 238 is slidably connected to the main body 231 and is configured to slide towards or away from the second rail 113 (referring to FIG. 1). The second joint conveying channel 236 is connected to the second moving shaft 238. The second limiting member is disposed at the main body 231 and is configured to limit the second moving shaft 238 to move between the second outer point Op2 and the second inner point Ip2 (see FIG. 11) along the first extending direction A1. The second outer point Op2 is located closer to the second rail 113 than the second inner point Ip2. The second moving shaft 238 is slidably connected to the first linkage 233.

The motor 235 includes a rotating shaft 235*a*, and is configured to make the rotating shaft 235*a* rotate along a first rotation direction (clockwise, for example) or along a second rotation direction opposite to the first rotation direction (counterclockwise, for example). An end of the swing arm 239 is connected to the rotating shaft 235*a*, and another end thereof is slidably connected to the first linkage 233. When the motor 235 make the rotating shaft 235*a* rotate along the first rotation direction, the first moving shaft 234 is indirectly driven (the rotating shaft 235*a* drives the first moving shaft 234 by the swing arm 239 and the first linkage 233) to move to the first outer point Op1, and the second moving shaft 238 is also indirectly driven (similarly, the rotating shaft 235*a* drives the second moving shaft 238 by the swing arm 239 and the first linkage 233) to the second outer point Op2, and meanwhile, the first joint conveying channel 232 may protrude from the upper surface 231*c* of the joint module 230 facing towards the upper slidable paper sheet module 120 to dock with the first channel module 121 (referring to the joint module 230 in FIG. 13 and FIG. 7), and the second joint conveying channel 236 may protrude from a lower surface 231*d* facing towards the lower slidable paper sheet module 140 to dock with the second channel module 141 for conveying the paper sheets. When the motor 235 rotates the rotating shaft 235*a* along the second rotation direction, the first moving shaft 234 is indirectly driven to move to the first inner point Ip1, and the second moving shaft 238 is also driven indirectly to the second inner point Ip2. In other words, when the first moving shaft 234 is located at the first outer point Op1, the second moving shaft 238 is located at the second outer point Op2 simultaneously. When the first moving shaft 234 is located at the first inner point Ip1, the second moving shaft 238 is located at the second inner point Ip2 simultaneously.

Specifically, the first linkage 233 includes a first slotted hole 233*a*, a second slotted hole 233*b*, a third slotted hole 233*c*, and a fourth slotted hole 233*d*. The first slotted hole 233*a* is substantially parallel to the first extending direction A1, and the another end of the swing arm 239 (an end that distal from the rotating shaft 235*a*) is slidably engaged with the first slotted hole 233*a*. The second slotted hole 233*b* is substantially parallel to the second extending direction A2. The main body 231 includes plural positioning pins 231*e*, and the positioning pins 231*e* are slidably engaged with the second slotted holes 233*b*. The third slotted hole 233*c* is not parallel to the first extending direction A1 and the second extending direction A2, and the first moving shaft 234 is slidably engaged with the third slotted hole 233*c*. The fourth slotted hole 233*d* is not parallel to the first extending direction A1 and the second extending direction A2, and the second moving shaft 238 is slidably engaged with the fourth slotted hole 233*d*.

In some embodiments, the first limiting member is a first slotted hole 231*a* formed on the main body 231. The first moving shaft 234 is slidably engaged with the first slotted hole 231*a*. Similarly, the second limiting member is a second slotted hole 231*b* formed on the main body 231. The second moving shaft 238 is slidably engaged with the second slotted hole 231*b*.

In some embodiments, the first extending direction A1 and the second extending direction A2 are perpendicular to each other, but the present invention is not limited thereto.

Figure 14:
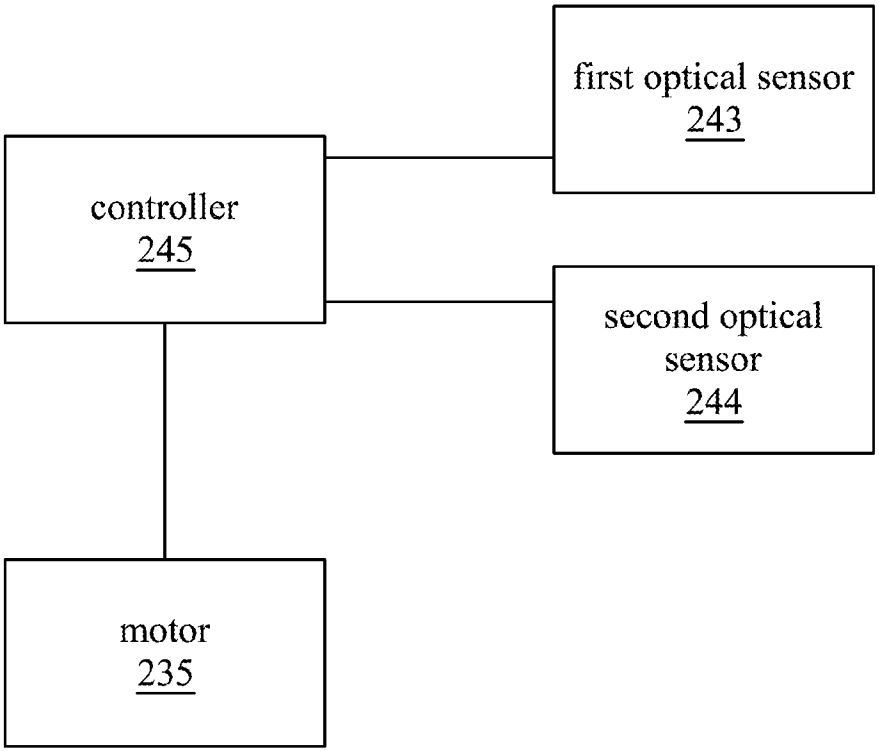
FIG. 14 is a circuit diagram of a joint module according to an embodiment.

It should be realized that, to activate the motor 235 to indirectly drive the first joint conveying channel 232 and the second joint conveying channel 236 upward and downward, in practical applications, plural triggering elements (not shown) may be disposed within the paper sheet handling apparatus 100. The triggering elements are configured to generate a first driving signal when the upper slidable paper sheet module 120 and the joint module 130 slide to the first installing location and the second installing location respectively (please refer to the positions at which the upper slidable paper sheet module 120 and lower slidable paper sheet module 140 are located in FIG. 7), and generate a second driving signal when the upper slidable paper sheet module 120 is not located at the first installing location or the lower slidable paper sheet module 140 is not located at the second installing location. The joint module 230 may include a controller 245 as shown in FIG. 14, which can drive the motor 235 to rotate the rotating shaft 235*a* along the first rotation direction according to the first driving signal, so as to indirectly make the first joint conveying channel 232 and the second joint conveying channel 236 extend out of the joint module 230 to dock with the first channel module 121 and the second channel module 141. The controller 245 may also drive the motor 235 to rotate the rotating shaft 235*a* along the second rotation direction according to the second driving signal, so as to indirectly make the first joint conveying channel 232 and the second joint conveying channel 236 be withdrawn back to the joint module 230.

In practical application, the aforementioned triggering device may be an optical sensor, an electromagnetic sensor, or a button-pressing sensor, but the present invention is not limited thereto.

Please refer to FIG. 14. FIG. 14 is a circuit diagram of a joint module according to an embodiment of the present invention. As shown in FIG. 14, in the present embodiment, the joint module 230 further includes a first optical sensor 243 and a second optical sensor 244. The first optical sensor 243 is disposed at the main body 231. The second optical sensor 244 is disposed at the main body 231. For example, as shown in FIG. 8, the first linkage 233 has a protruding part 233*e*, a first recessed part 233*f*, and a second recessed part 233*g* located at the edge of the first linkage 233. The first optical sensor 243 and the second optical sensor 244 are light interrupters, but the present invention is not limited thereto.

As shown in FIG. 9, when the first moving shaft 234 is located at the first inner point Ip1 (at the same time, the second moving shaft 238 is located at the second inner point Ip2), the protruding part 233*e* of the first linkage 233 does not shade the first optical sensor 243, and the first recessed part 233*f* of the second optical sensor 244 located at the first linkage 233 is not shaded either, such that the first linkage 233 does not trigger the first optical sensor 243 and the second optical sensor 244.

As shown in FIG. 12, when the first moving shaft 234 is located at the first outer point Op1, the protruding part 233*e* of the first linkage 233 shades the first optical sensor 243, and the second optical sensor 244 is located at the second recessed part 233*g* of the first linkage 233 and thus is not shaded, such that the first linkage 233 triggers the first optical sensor 243 but does not trigger the second optical sensor 244.

When the first moving shaft 234 moves between the first inner point Ip1 and the first outer point Op1, the protruding part 233*e* of the first linkage 233 has not yet arrived at the first optical sensor 243 and thus does not shade the first optical sensor 243, and the portion between the first recessed part 233*f* and the second recessed part 233*g* of the first linkage 233 shades the second optical sensor 244, and thus the first linkage 233 triggers the second optical sensor 244 but does not trigger the first optical sensor 243.

The controller 245 is configured to generate a first stop signal when the first linkage 233 does not trigger the first optical sensor 243 and the second optical sensor 244 (as shown in FIG. 9), and configured to generate a second stop signal when the first linkage 233 triggers the first optical sensor 243 but does not trigger the second optical sensor 244 (as shown in FIG. 12). The activated motor 235 is stopped according to the first stop signal and the second stop signal.

In addition, the joint module 230 further includes two second linkages 237 (one of the second linkages 237 is located at the left side of the joint module 230 in FIG. 8, and thus is blocked), a first connecting shaft 240, two third linkages 241 (one of the third linkages 241 is located at the left side of the joint module 230 in FIG. 8, and thus is blocked), and a second connecting shaft 242. The second linkage 237 is pivotally connected to two ends of the first moving shaft 234 respectively. The first connecting shaft 240 is rotatably connected to the main body 231, and is connected between the second linkages 237. The third linkage 241 is pivotally connected to two ends of second moving shaft 238. The second connecting shaft 242 is rotatably connected to the main body 231, and is connected between the third linkages 241. By the structural configuration, the first moving shaft 234 and the second moving shaft 238 can respectively drive the first joint conveying channel 232 and second joint conveying channel 236 more smoothly.

From the detail description of the embodiments said above, it is apparent that an additional joint module is added to the paper sheet handling apparatus of the present invention between the upper slidable paper sheet module and the lower slidable paper sheet module, so as to overcome the issue that the paper sheets might be jammed therebetween when passing between the upper slidable paper sheet module and the lower slidable paper sheet module. Also, the joint module of the present invention includes joint conveying channels that can extend to the upper slidable paper sheet module and the lower slidable paper sheet module. Before the upper slidable paper sheet module and the lower slidable paper sheet module slide to the predetermined installing location within the paper sheet handling apparatus, the joint conveying channel of the joint module will not protrude to interfere with the structure of the upper slidable paper sheet module and the lower slidable paper sheet module. When the upper slidable paper sheet module and the lower slidable paper sheet module slide to the predetermined location within the paper sheet handling apparatus, the joint conveying channel of the joint module will be driven to protrude towards the upper slidable paper sheet module and the lower slidable paper sheet module respectively, so as to dock with the first module channel of the upper slidable paper sheet module and the second module channel of the lower slidable paper sheet module respectively.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A paper sheet handling apparatus, comprising:

a housing;

a first unit disposed within the housing and used to receive and dispense a paper sheet;

a second unit disposed within the housing and used to store the paper sheet, wherein at least one of the first unit and the second unit is a slidable paper sheet module that is slidably disposed at a rail of the housing and includes a module channel; and a joint module disposed between the first unit and the second unit, the joint module comprising:

a main body located at a side of the rail;

a moving shaft slidably connected to the main body and configured to slide towards or away from the rail;

a joint conveying channel connected to the moving shaft; and a limiting member disposed at the main body and configured to limit the moving shaft to move between an outer point and an inner point, wherein the outer point is located closer to the rail than to the inner point, and the limiting member is a slotted hole formed on the main body, and the moving shaft is slidably engaged to the slotted hole;

wherein when the moving shaft moves to the outer point, the joint conveying channel protrudes from a surface of the joint module facing towards the slidable paper sheet module, so as to dock with the module channel for conveying the paper sheet.

2. The paper sheet handling apparatus of claim 1, wherein the joint module further comprises:

a linkage pivotally connected to the main body and the moving shaft;

wherein when the slidable paper sheet module is sliding along the rail to an installation location in the housing, the slidable paper sheet module pushes the linkage to rotate, so as to move the moving shaft to the outer point and drive the joint conveying channel to slide towards the rail.

3. The paper sheet handling apparatus of claim 2, wherein the joint module further comprises a restoring member, the restoring member is operatively connected between the main body and the linkage, and the restoring member is configured to make the linkage rotate with respect to the main body so as to move the moving shaft towards the inner point.

4. The paper sheet handling apparatus of claim 1, wherein the limiting member is configured to limit the moving shaft to move relative to the main body along a first extending direction, and the joint module further comprises:

a first linkage slidably connected to the main body and configured to move relative to the main body along a second direction, wherein the moving shaft is slidably connected to the first linkage;

a motor having a rotating shaft and configured to rotate the rotating shaft along a first rotation direction or along a second rotation direction opposite to the first rotation direction; and a swing arm, wherein one end of the swing arm is connected to the rotating shaft and another end of the swing arm is slidably connected to the first linkage;

wherein when the motor drives the rotating shaft to rotate along the first rotation direction, the moving shaft is indirectly driven to move to the outer point, and when the motor drives the rotating shaft to rotate along the second rotation direction, the moving shaft is indirectly driven to move to the inner point.

5. The paper sheet handling apparatus of claim 4, wherein the joint module further comprises:

a first optical sensor disposed at the main body;

a second optical sensor disposed at the main body, wherein when the moving shaft is located at the inner point, the first linkage does not trigger the first optical sensor and the second optical sensor; when the moving shaft is located at the outer point, the first linkage triggers the first optical sensor but does not trigger the second optical sensor; and when the moving shaft moves between the inner point and the outer point, the first linkage triggers the second optical sensor but does not trigger the first optical sensor; and a controller configured to generate a first stop signal when the first linkage does not trigger the first optical sensor and the second optical sensor, the controller being further configured to generate a second stop signal when the first linkage triggers the first optical sensor but does not trigger the second optical sensor, wherein the activated motor is stopped according to the first stop signal and the second stop signal.

6. The paper sheet handling apparatus of claim 5, wherein the limiting member is a slotted hole formed on the main body, and the moving shaft is slidably engaged with the slotted hole.

7. The paper sheet handling apparatus of claim 6, wherein the first linkage has a first sliding slot, a second sliding slot, and a third sliding slot; the first sliding slot is substantially parallel to the first extending direction; the another end of the swing arm is slidably engaged with the first sliding slot; the second sliding slot is substantially parallel to the second extending direction; the main body is slidably engaged with the second sliding slot; the third sliding slot is not parallel to the first extending direction and the second extending direction; and the moving shaft is slidably engaged with the third sliding slot.

8. The paper sheet handling apparatus of claim 7, wherein the joint module further comprises:

two second linkages pivotally connected to two ends of the moving shaft respectively; and a connecting shaft rotatably connected to the main body and connected between the second linkages.

9. A joint module disposed within a housing and located between a first unit used to receive and dispense a paper sheet and a second unit used to store the paper sheet, at least one of the first unit and the second unit being a slidable paper sheet module slidably disposed within the housing, the joint module comprising:

a main body;

a moving shaft slidably connected to the main body;

a joint conveying channel connected to the moving shaft; and a limiting member disposed at the main body and configured to limit the moving shaft to move between an outer point and an inner point, wherein the outer point located is closer to the slidable paper sheet module than to the inner point, and the limiting member is a slotted hole formed on the main body, and the moving shaft is slidably engaged to the slotted hole;

wherein when the moving shaft moves to the outer point, the joint conveying channel protrudes from a surface of the joint module facing towards the slidable paper sheet module, so as to dock with a channel module of the slidable paper sheet module for conveying the paper sheet.

10. The joint module of claim 9, further comprising:

a linkage pivotally connected to the main body and the moving shaft;

wherein when the slidable paper sheet module moves to an installation location in the housing, the slidable paper sheet module pushes the linkage to rotate, so as to move the moving shaft to the outer point and drive the joint conveying channel to slide towards the slidable paper sheet module.

11. The joint module of claim 10, further comprising a restoring member operatively connected between the main body and the linkage, and the restoring member is configured to make the linkage rotate with respect to the main body and move the moving shaft to the inner point.

12. The joint module of claim 9, wherein the limiting member is configured to limit the moving shaft to move along a first extending direction relative to the main body, and the joint module further comprises:

a first linkage slidably connected to the main body and configured to move along a second extending direction relative to the main body, wherein the moving shaft is slidably connected to the first linkage;

a motor having a rotating shaft and configured to rotate the rotating shaft along a first rotation direction or along a second rotation direction opposite to the first rotation direction; and a swing arm, wherein an end of the swing arm is connected to the rotating shaft and another end of the swing arm is slidably connected to the first linkage;

wherein when the motor drives the rotating shaft to rotate along the first rotating direction, the moving shaft is indirectly driven to move to the outer point; and when the motor drives the rotating shaft to rotate along the second rotation direction, the moving shaft is indirectly driven to move to the inner point.

13. The joint module of claim 12, further comprising:

a first optical sensor disposed at the main body;

a second optical sensor disposed at the main body, wherein when the moving shaft is located at the inner point, the first linkage does not trigger the first optical sensor and the second optical sensor; when the moving shaft is located at the outer point, the first linkage triggers the first optical sensor but does not trigger the second optical sensor; and when the first linkage moves between the inner point and the outer point, the first linkage triggers the second optical sensor but does not trigger the first optical sensor; and a controller configured to generate a first stop signal when the first linkage does not trigger the first optical sensor and the second optical sensor, the controller being further configured to generate a second stop signal when the first linkage triggers the first optical sensor but does not trigger the second optical sensor, wherein the activated motor is stopped according to the first stop signal and the second stop signal.

14. The joint module of claim 13, wherein the limiting member is a slotted hole formed on the main body, and the moving shaft is slidably connected to the slotted hole.

15. The joint module of claim 14, wherein the first linkage has a first sliding slot, a second sliding slot, and a third sliding slot; the first sliding slot is substantially parallel to the first extending direction; the another end of the swing arm is slidably engaged with the first sliding slot; the second sliding slot is substantially parallel to the second extending direction; the main body is slidably engaged with the second sliding slot; the third sliding slot is not parallel to the first extending direction and the second extending direction; and the moving shaft is slidably engaged with the third sliding slot.

16. The joint module of claim 15, further comprising:

two second linkages pivotally connected to two ends of the moving shaft; and a first connecting shaft rotatably connected to the main body and connected between the second linkages.

* * * * *